US007872591B2

(12) United States Patent
Kane et al.

(10) Patent No.: US 7,872,591 B2
(45) Date of Patent: Jan. 18, 2011

(54) DISPLAY OF NON-LINKED EOT UNITS HAVING AN EMERGENCY STATUS

(75) Inventors: Mark Edward Kane, Orange Park, FL (US); James Francis Shockley, Orange Park, FL (US)

(73) Assignee: Invensys Rail Corporation, Louisville, KY (US)

( * ) Notice: Subject to any disclaimer, the term of this patent is extended or adjusted under 35 U.S.C. 154(b) by 592 days.

(21) Appl. No.: 11/929,605

(22) Filed: Oct. 30, 2007

(65) Prior Publication Data

US 2009/0109013 A1 Apr. 30, 2009

(51) Int. Cl.
*G08G 1/00* (2006.01)

(52) U.S. Cl. ..... 340/902; 340/903; 340/438; 340/539.1; 701/213; 701/301

(58) Field of Classification Search ..... 340/902, 340/903, 438, 539.1, 466; 246/62, 120, 178, 246/180, 20, 47; 701/19, 117, 213, 301
See application file for complete search history.

(56) References Cited

U.S. PATENT DOCUMENTS 5,016,840 A * 5/1991 Bezos ..... 246/187 R
5,267,473 A 12/1993 Bezos et al.
5,377,938 A 1/1995 Bezos et al.
5,507,457 A 4/1996 Kull
5,757,291 A 5/1998 Kull
5,785,283 A 7/1998 Ehrenberger et al.
5,828,979 A 10/1998 Polivka et al.
5,866,811 A 2/1999 Skantar
5,978,718 A 11/1999 Kull
5,995,881 A 11/1999 Kull
6,081,769 A 6/2000 Curtis
6,087,950 A 7/2000 Capan
6,095,618 A 8/2000 Heneka et al.
6,195,600 B1 2/2001 Kettle, Jr.
6,227,625 B1 5/2001 Gaughan
6,236,185 B1 5/2001 Hines et al.
6,311,109 B1 10/2001 Hawthorne et al.
6,371,416 B1 4/2002 Hawthorne (Continued)

FOREIGN PATENT DOCUMENTS

CA 2185084 C 1/2000

(Continued)

OTHER PUBLICATIONS

Kull, Robert C., "End-of-Train Monitor System for Caboose Elimination," Vehicular Technology Conference, 1985, 35th IEEE, vol. 35, 21-23, pp. 299-303, May 23, 1985.

(Continued)

*Primary Examiner*—Hung T. Nguyen
(74) *Attorney, Agent, or Firm*—DLA Piper LLP US

(57) ABSTRACT

A head of train device is configured to examine messages received from end of train units other than the end of train unit attached to the same train and to alert an operator to the presence of an end of train unit from another train that indicates that the end of train unit from the other train has stopped. The indication can take the form of a zero brake pipe pressure.

21 Claims, 7 Drawing Sheets

U.S. PATENT DOCUMENTS

| | | | |
|---|---|---|---|
| 6,377,877 | B1 | 4/2002 | Doner |
| 6,470,245 | B1 | 10/2002 | Proulx |
| 6,609,049 | B1 | 8/2003 | Kane et al. |
| 6,622,067 | B1 | 9/2003 | Lovelace, II et al. |
| 6,701,228 | B2 | 3/2004 | Kane et al. |
| 6,799,097 | B2 | 9/2004 | Villarreal Antelo et al. |
| 6,824,110 | B2 | 11/2004 | Kane et al. |
| 6,845,953 | B2 | 1/2005 | Kane et al. |
| 6,853,888 | B2 | 2/2005 | Kane et al. |
| 6,862,502 | B2 | 3/2005 | Peltz et al. |
| 6,863,246 | B2 | 3/2005 | Kane et al. |
| 6,865,454 | B2 | 3/2005 | Kane et al. |
| 6,903,658 | B2 | 6/2005 | Kane et al. |
| 6,915,191 | B2 | 7/2005 | Kane et al. |
| 6,957,131 | B2 | 10/2005 | Kane et al. |
| 6,970,774 | B2 | 11/2005 | Kane et al. |
| 6,996,461 | B2 | 2/2006 | Kane et al. |
| 7,073,753 | B2 | 7/2006 | Root et al. |
| 7,096,096 | B2 | 8/2006 | Kane et al. |
| 7,283,897 | B2 | 10/2007 | Kane et al. |
| 2003/0144772 | A1 | 7/2003 | Proulx |
| 2003/0183729 | A1 | 10/2003 | Root et al. |
| 2003/0222981 | A1 | 12/2003 | Kisak et al. |
| 2004/0120305 | A1 | 6/2004 | Aiken, II et al. |
| 2005/0107954 | A1 | 5/2005 | Nahla |
| 2006/0184290 | A1 | 8/2006 | Kane et al. |
| 2007/0095988 | A1 | 5/2007 | Kane et al. |
| 2007/0112482 | A1 | 5/2007 | Kane et al. |
| 2007/0170314 | A1 | 7/2007 | Kane et al. |

FOREIGN PATENT DOCUMENTS

| | | | |
|---|---|---|---|
| KR | 2002-0060892 | A | 7/2002 |

OTHER PUBLICATIONS

International Search Report issued in PCT/US2008/071146, mailed Dec. 19, 2008.

* cited by examiner

DISPLAY OF NON-LINKED EOT UNITS HAVING AN EMERGENCY STATUS

FIELD

The invention relates generally to head of train and end of train units used in the railroad industry.

BACKGROUND

Within the railroad industry, end of train (EOT) units (sometimes also referred to as end of train devices, or ETDs) are typically attached at the rear of the last car on a train and typically communicate with a head of train (HOT) device typically located on a lead locomotive or a train or consist. EOT units were originally designed to perform some of the functions previously performed by train personnel located in the caboose. Today, EOT units can perform a variety of functions. EOT units include a pressure sensor to monitor air pressure in the air brake pipe and periodically transmit this information to the HOT device, which displays the information to the train crew responsible for operating the train. EOT units also often include an end-of-train marker light that, in the United States, must meet FRA (Federal Railroad Administration) regulations, in order to alert others to the presence of the end of train at night and under other low light conditions. Two-way EOT units can accept an emergency brake command from the HOT device to open a valve attached to the air brake pipe, which causes a loss of air pressure in the air brake pipe, thereby causing an emergency brake application (which is the most severe application of the brakes). Some EOT units include motion detectors that are used to inform the HOT as to whether, and in some cases in which direction, a train is moving. Other EOT units include GPS receivers that are used to transmit location information pertaining to the end of the train to HOT equipment as discussed in U.S. Pat. No. 6,081,769.

Because the EOT units are located at the end of a train, supplying power to EOT units is an important consideration. As discussed in U.S. Pat. Nos. 5,267,473 and 6,236,185, it is known to supply power to EOT units using batteries or a combination of batteries and air-powered generators connected to the brake pipe. In order to conserve battery power, EOT units are usually configured to power down when the unit has been in a horizontal orientation for a period of time, such as after being removed from a train by train yard personnel.

EOT units usually communicate with the HOT devices using radio-based communications. Because of the nature of modern freight railroading, it should be understood that an HOT device is required to communicate with many different EOT units and vice-versa as consists are formed and broken down. Moreover, it is often the case that several HOT devices and EOT units will be within radio communication distance of each other at one time, such as when a train/consist on which the EOT unit and HOT device are mounted is in a train yard. Thus, there is a need for HOT devices to determine which EOT unit messages are intended for it and vice-versa.

In order to meet this need, conventional EOT devices are assigned unique serial numbers and configured to include this serial number in all outgoing communications, and EOT units having a two-way capability only respond to incoming communications that include the unique serial number for the HOT after the EOT unit has been armed. Similarly, HOT devices have the ability to be configured to ignore messages from all EOT units other than the particular EOT device specified by an operator. "Arming" or "linking" an EOT unit typically requires a person to push an arm button on the EOT unit. This causes the EOT unit to send an ARM request message. When the HOT receives such a message with the correct EOT serial number, the HOT sends an ARM confirm message including the EOT unit's serial number to the EOT unit. The EOT responds with an ARM acknowledge message to complete the process. An operator typically configures an HOT device for a particular EOT unit by setting a thumbwheel or other input device to the unique serial number of the desired EOT unit, which is typically imprinted on the outside of the housing of the EOT unit. Upon receiving such an identifier from the operator, the conventional HOT device will display information from messages transmitted by that particular EOT unit and ignore communications from all other EOT units.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of end of train units. Specific details, such as types of positioning systems and time periods, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1A:
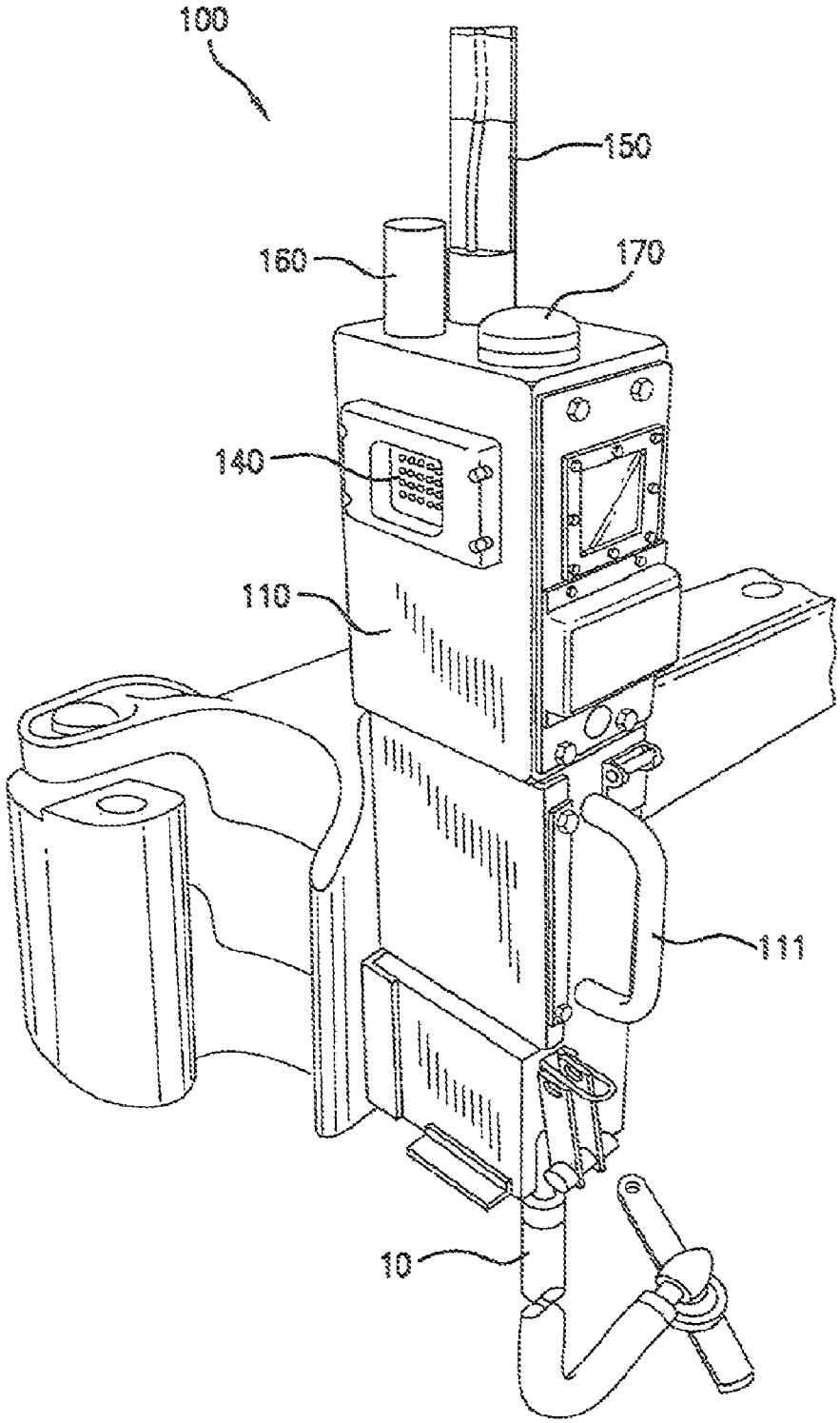
FIGS. 1*a* and 1*b* are perspective and front views, respectively, of an EOT unit according to one embodiment of the invention.
Figure 1B:
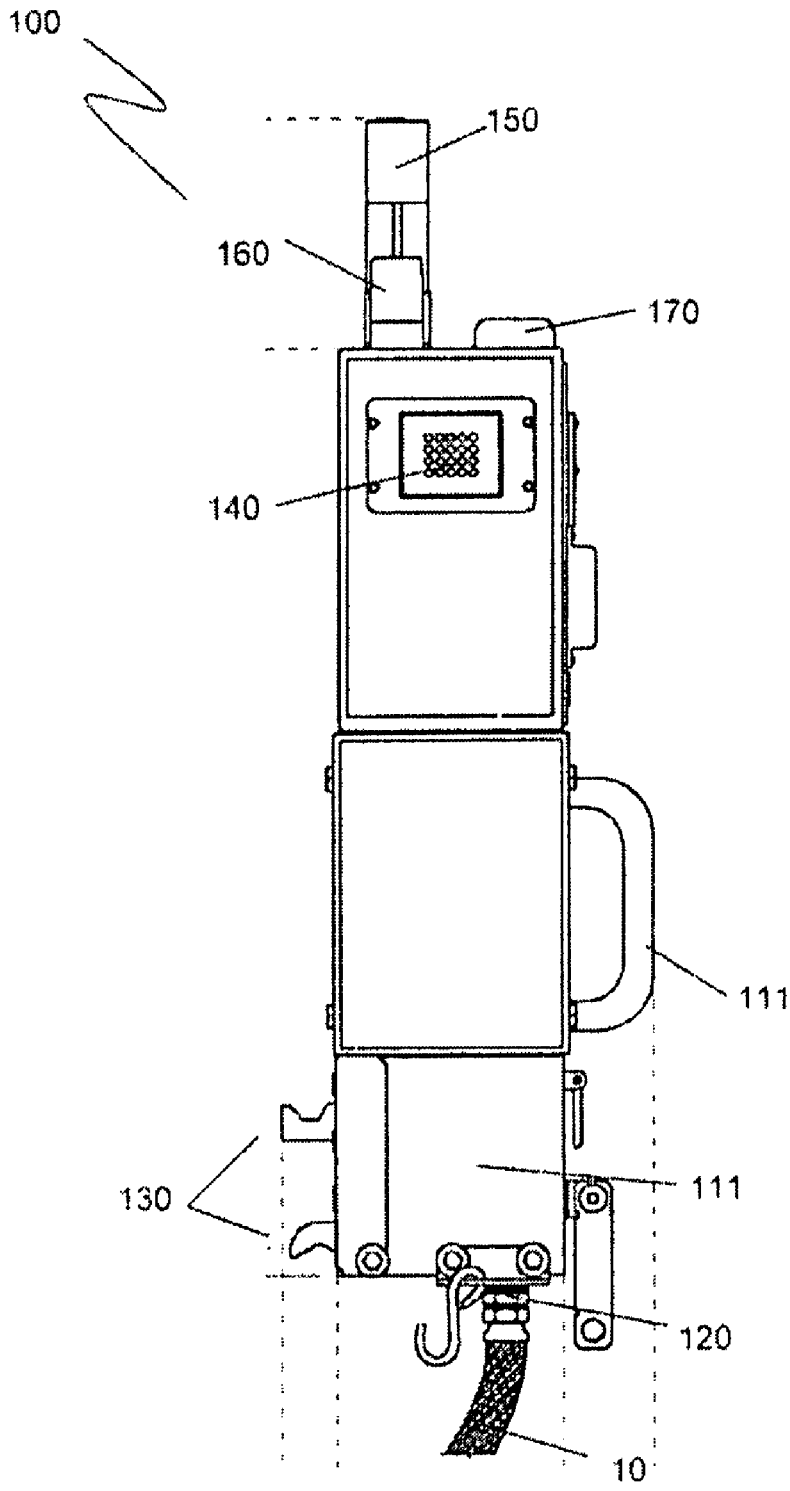

FIGS. 1*a* and *b* illustrate an embodiment of EOT unit 100 with which the present invention may be used. The EOT unit 100 includes a housing 110 in which the internal components of the EOT unit 100 (discussed in further detail below) are located. The housing typically has imprinted thereon an identifier of the EOT unit. The identifier is used to configure an HOT device to identify the EOT unit to the HOT device as discussed above. A handle 111 is attached to the housing 110 to facilitate the installation and removal of the EOT unit 100 from a train car. Also attached to the housing is a connector 120 for connecting the EOT unit 100 to an air brake pipe 10 which is in fluid communication with the train's air brake pipe (not shown in FIG. 1*a* or 1*b*). Also attached to the housing 110 is a coupler 130 which couples the EOT unit 100 to a train car coupling. The EOT unit 100 also includes a marker light 140 attached to the housing 110. Three antennas are also attached to the housing 110: a first antenna 150 for communicating with the HOT, a second antenna 160 for communicating with a cellular base station network, and a third antenna 170 for receiving messages from GPS satellites.

Figure 2:
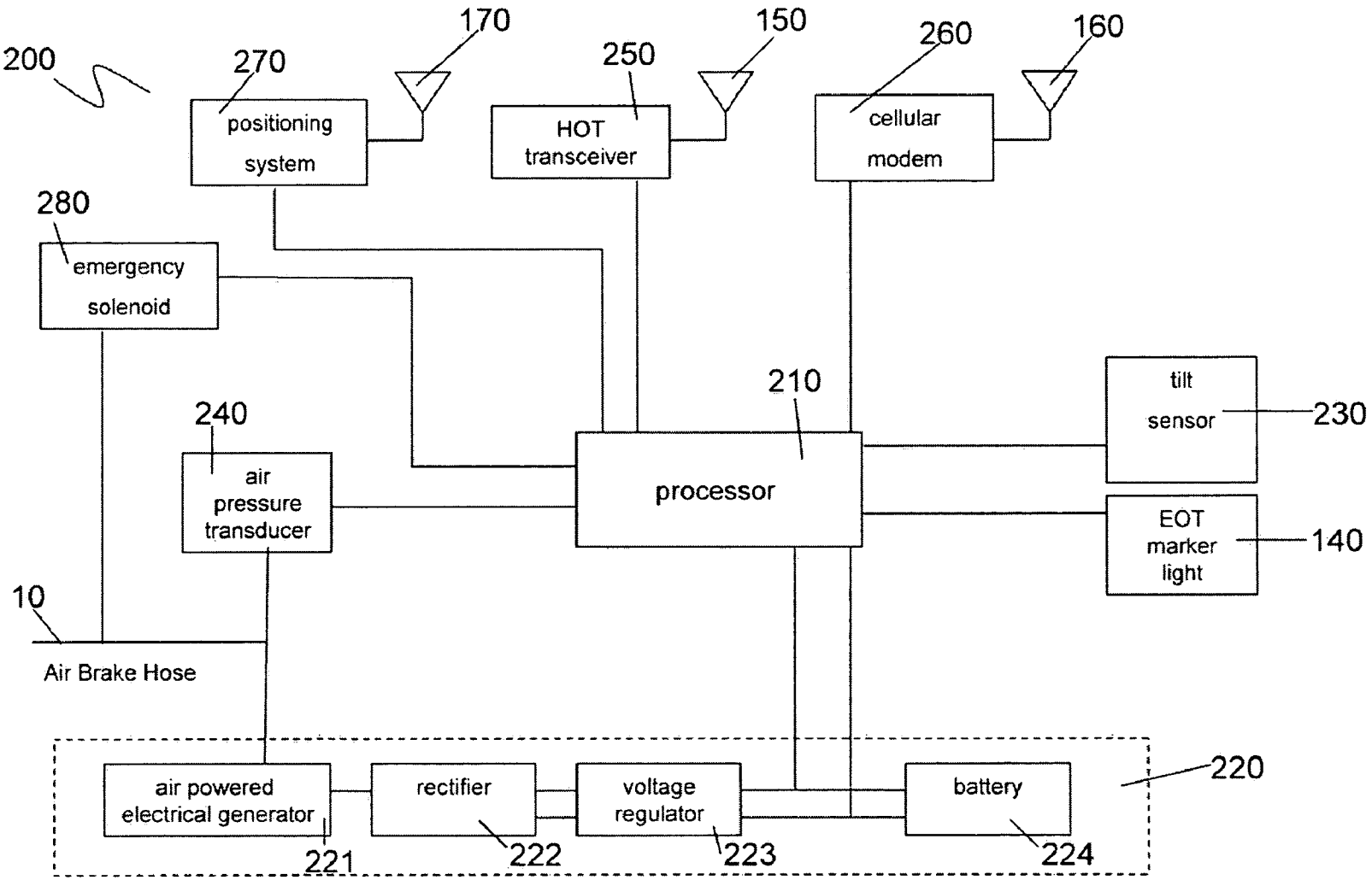
FIG. 2 is a block diagram of the EOT unit of FIG. 1.

A functional block diagram 200 of the EOT unit 100 of FIG. 1 is illustrated in FIG. 2. The EOT unit 100 is controlled by a processor 210. As used herein, "processor" includes a general purpose computer, a dedicated computer, a special purpose computer, a microprocessor, a digital signal processor, a reduced instruction set computer, or any other device capable of processing data, including devices fabricated using discrete logic components. The processor 210 receives power from a power subsystem 220 which includes an air-powered electrical generator 221 connected to the air brake hose 10, a rectifier 222, a voltage regulator 223 and one or more batteries 224. Details concerning the power subsystem 224 are discussed in greater detail in corresponding U.S. patent application Ser. No. 10/611,279.

The processor 210 is connected to control an EOT marker light 140 (although a direct connection is illustrated in FIG. 2, those of skill in the art will understand that the processor 210 may supply the control of power to the EOT marker light 140 via a relay or similar device) in accordance with applicable FRA regulations. Also connected to the processor 210 is a tilt sensor 230. The processor 210 uses the tilt sensor 230 to determine when the EOT unit 100 has been placed in a horizontal position so that the processor 210 can take the EOT unit to a low power state to conserve battery power.

Also connected to the processor 210 is an air pressure transducer 240, which is in fluid communication with the air brake pipe and configured to monitor the pressure in the air brake pipe. The processor 210 reads the pressure in the air brake pipe and periodically transmits this information to the HOT using the HOT transceiver 250.

An emergency solenoid 280 is also connected to the processor 210 and the air brake pipe. When the processor 210 receives an emergency braking command from the HOT via the HOT transceiver 250, the processor 210 controls the solenoid 280 to open, causing a loss of pressure in the air brake pipe and an emergency application of the train's brakes. In some embodiments, another solenoid (not shown in FIG. 2) is also connected to the processor 210 and between the air brake pipe and the air powered generator 221. This solenoid is used to perform certain tests required by the FRA.

The processor 210 is further connected to a positioning system 270, which is a GPS receiver in preferred embodiments but may also be an INS (inertial navigation system), LORAN device, or any other positioning system. The positioning system 270 supplies the processor 210 with reports on the position of the EOT unit 100.

The processor 210 is also connected to a cellular modem 260. The processor 210 uses the cellular modem to send reports including an identifier of the EOT unit 100 and location (and preferably time) information obtained from the positioning system 270 to an EOT tracking station at periodic intervals. The processor 210 also receives "page" messages (messages requesting the EOT unit to report its current location) and "disable" messages (messages instructing the EOT unit to enter an non-operational state) via the cellular modem 260.

During normal operation, the processor 210 is configured to send periodic messages to the HOT via the HOT transceiver 250. These messages have a header that includes the EOT unit's serial number, and include the air brake pipe pressure and an indication as to whether or not the train is moving based upon an input from a motion sensor (not shown in FIG. 2). If the EOT unit includes a GPS receiver 270, these periodic messages will also include a position reported by the GPS receiver 270. These messages are typically transmitted approximately once per minute. The EOT unit will also transmit a message upon the occurrence of certain events, such as the initiation of emergency braking, a drop of 2 pounds or more in the air brake pipe pressure, if the motion sensor indicates that the train has started or stopped moving, etc.

In addition to the normal operations discussed above, the processor 210 periodically transmits location messages to an entity located off the train via the cellular modem 260 for purposes unrelated to the present invention. These communications are discussed in further detail in co-pending U.S. patent application Ser. No. 11/339,801, entitled "Method and System For Locating End of Train Units," the contents of which are hereby incorporated by reference herein. These communications will not be discussed further herein to avoid obscuring the present invention. It should be understood, however, that the present invention may be practiced with EOT units other than the exemplary EOT unit discussed above. For example, the invention may be practiced with EOT units that do not include a cellular modem 260 or a positioning system 270 but rather may be used with any conventional EOT unit, including conventional one-way EOT units.

Figure 3:
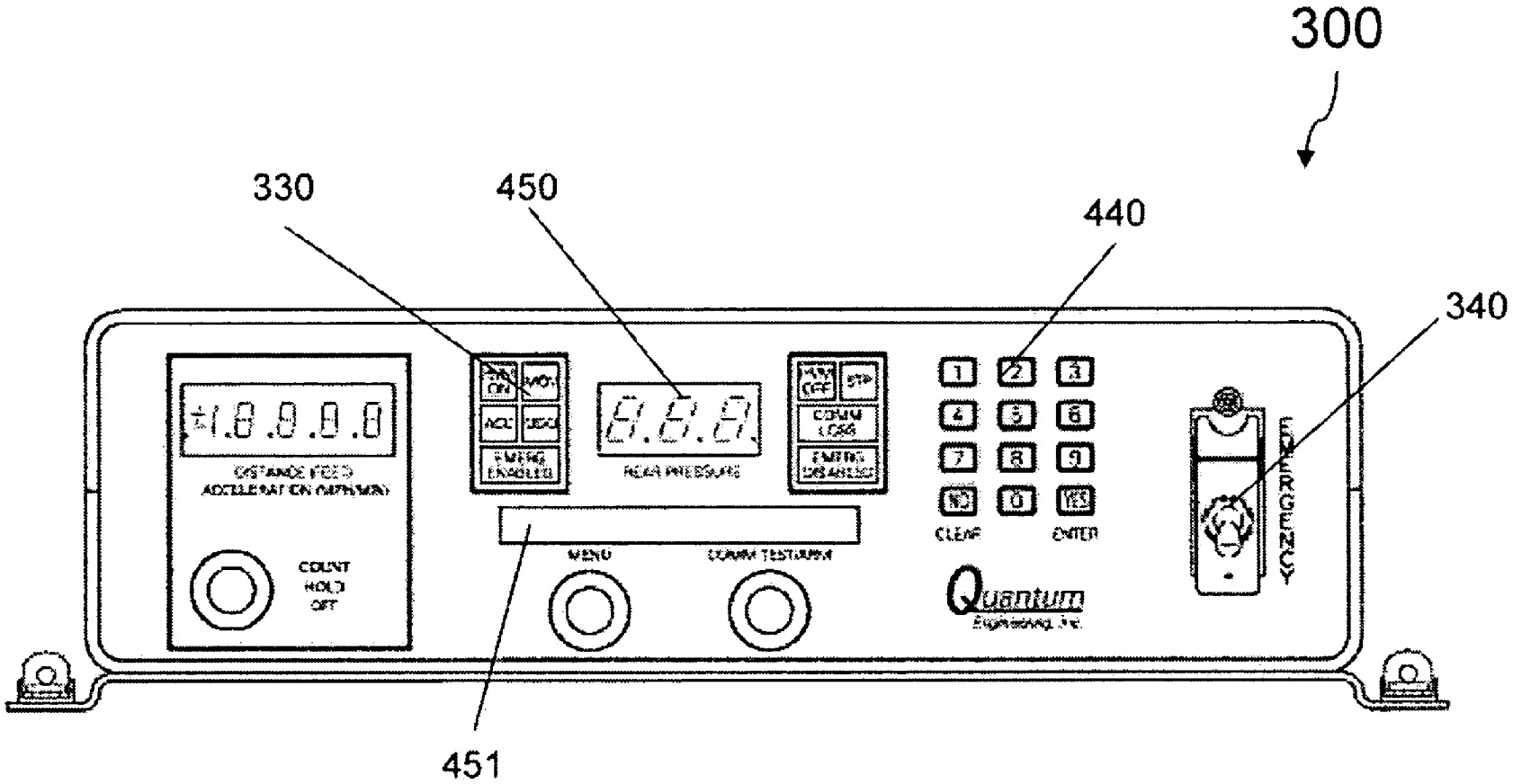
FIG. 3 is a perspective view of an HOT device according to an embodiment of the invention.

An exemplary HOT device 300 is illustrated in FIG. 3. The HOT device includes a first display 450 for displaying the air brake pipe pressure and, a second display 451 for displaying in a visual alert indicating the presence of a nearby EOT device in an emergency condition (e.g., "40355 IN EMGCY 2 MI"). The HOT device further includes a keypad 440 which can be used to input a serial number of an EOT unit attached to the same train as the HOT device 300. The HOT device 300 also includes an indicator light 330 which is lit when the train is in motion and which is dark when the train is not in motion. A switch 340 is used to initiate an emergency braking operation at the EOT corresponding to the serial number set at the set of switches 440. Other indicator lights are used for various purposes, such as indicating whether there is a communications fault, when power is on, etc.

Figure 4:
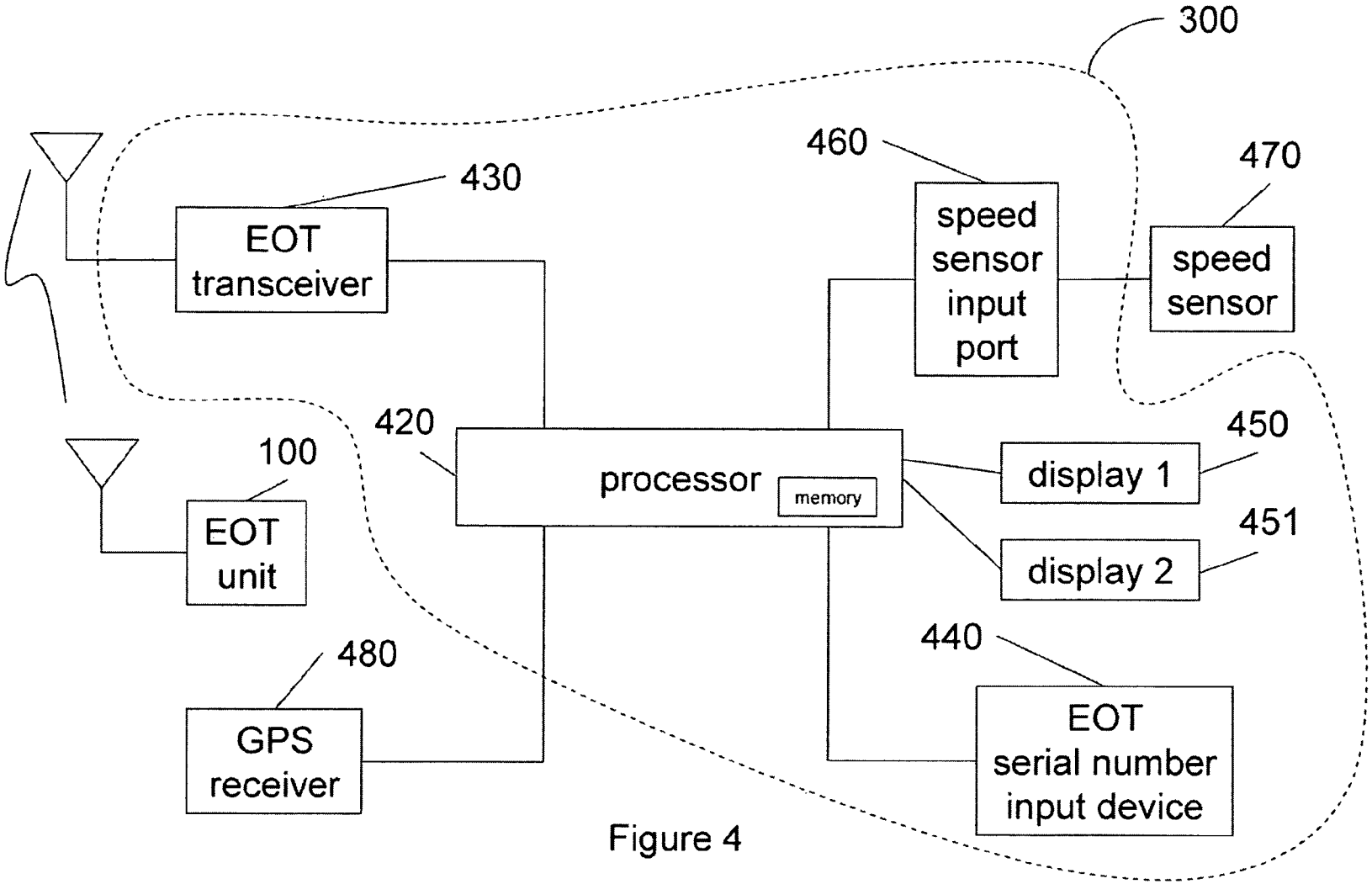
FIG. 4 is a block diagram of the HOT device of FIG. 3 according to an embodiment of the invention.

A block diagram of the HOT device 300 of FIG. 3 is illustrated in FIG. 4. The HOT device 300 includes a processor 420. An EOT transceiver is connected to the processor 420. The EOT transceiver 430 configured to communicate with the HOT transceiver 250 of the EOT unit 100. Also connected to the processor 420 is an EOT serial number input device 440. As discussed above, the EOT serial number input device 440 may include a keypad (or a plurality of thumbwheel switches or other configurable switches/devices) that allows an operator to enter a number of an EOT unit which is attached to a same train on which the HOT device 300 is mounted.

A display 450 is also connected to the processor 420. The processor 420 can control the display 450 during normal operations to display the brake pipe pressure. A second display 451 is also connected to the processor 420. The processor 420 may cause the display 451 to display an alert message indicating the presence of a non-linked EOT reporting an emergency condition or a zero brake pipe pressure as discussed above.

A speed sensor input port 460 is also attached to the processor 420. The input port 460 is connected to a speed sensor 470 such as an axle drive tachometer or other device that measures speed (it will be understood by those of skill in the art that such device may provide analog signals which require conversion to digital form by the input port 460).

Finally, a GPS receiver 480 (or any other device from which a location of the train can be determined, such as a LORAN receiver) is also connected to the processor 420. The GPS receiver 480 provides the position of the HOT to the processor 420. This information may be used for determining a distance between the HOT and an EOT unit in those embodiments in which the EOT unit is also equipped with a GPS receiver 270. In some embodiments, the GPS position information from the GPS receiver 480 is used to determine if the train is in a location (e.g., a train yard) in which one would normally expect to find EOT units in an emergency/zero brake pipe pressure condition. The processor 420 may alter or suppress the alert to the operator under such circumstances. It should be understood that the information from the GPS receiver may be used in place of the data from the speed sensor 470, and that the speed sensor 470 and speed sensor input port 460 can be eliminated in some embodiments.

Figure 5A:
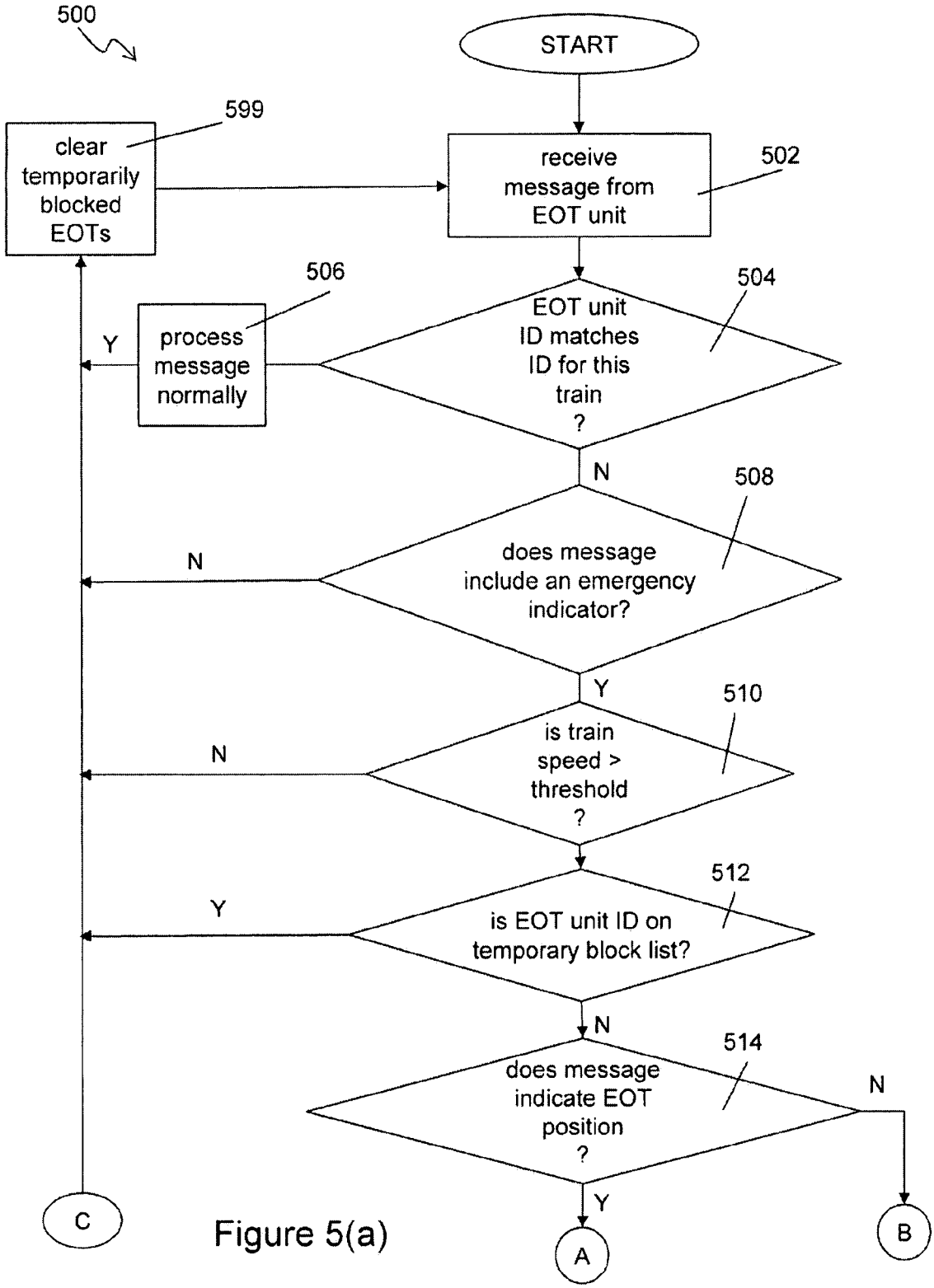
FIGS. 5*a* and 5*b* are a flow chart illustrating the processing performed by HOT device of FIG. 3 according to an embodiment of the invention.
Figure 5B:
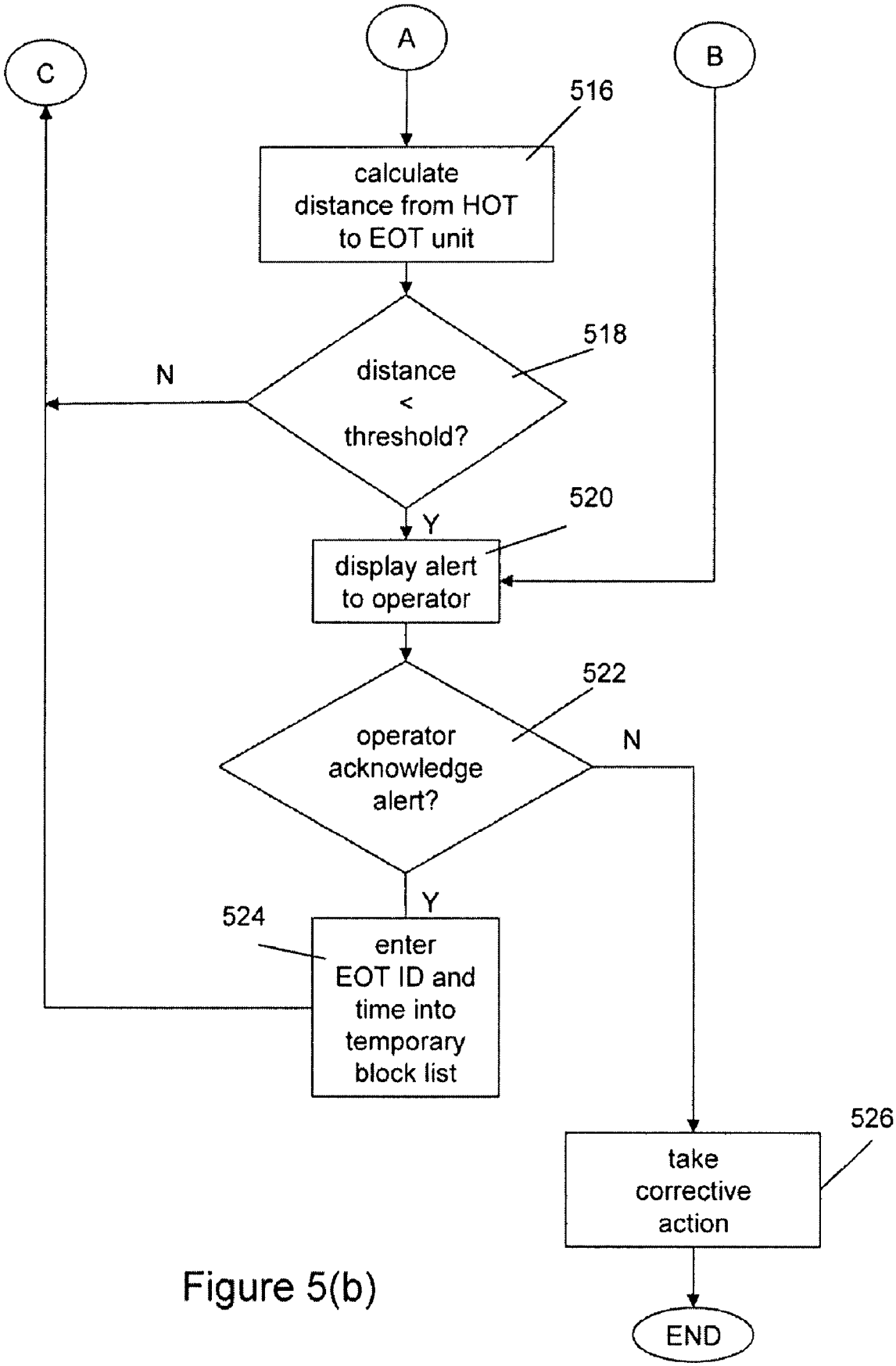

The processing performed by the processor 420 in one embodiment is illustrated by the flowchart 500 of FIGS. 5(*a*) and 5(*b*). The process begins when a message from an EOT unit is received at step 502. The processor 420 determines whether the EOT unit identifier in the message corresponds to the serial number read from the EOT serial number input device 440 at step 504. If there is a match, indicating that the message is from the EOT attached to the same train on which the HOT device 300 is mounted, the processor 420 processes the message normally at step 506. Normal processing includes displaying the information in the EOT message (e.g., the brake pipe pressure, motion status, etc.) to the operator on the display 450.

If the EOT unit identifier in the message does not correspond to the serial number read from the EOT serial number input device 440 at step 504, the message is checked to determine if it includes an indication of an emergency condition (i.e., an indication that the EOT unit has received an emergency braking command or that the EOT unit is reading zero brake pipe pressure) at step 508. If there is no emergency indication, the message is effectively ignored and step 599 (which will be explained below) is performed.

If an emergency indication is included in the message at step 508, the speed of the train is obtained from the speed sensor 470 or the GPS receiver 480 and compared to a threshold at step 510. The threshold is typically a low speed such as three m.p.h. at which an operator can be expected to see any train stopped or derailed on the tracks ahead and stop the train before a collision with such stopped or derailed train occurs. If the train speed is below the threshold, the message is effectively ignored and step 599 is performed. It should be understood that the test of step 510 is performed in order to avoid excessive "false alarms" that desensitize an operator. For example, a train might be moving at a speed below three m.p.h. in a train yard, which is a location in which one might ordinarily expect to encounter several EOT units transmitting messages including emergency indications and at which alerting an operator would be annoying. It should be understood that the test of step 510 is optional and may not be performed in all embodiments.

If the train speed is above the threshold at step 510, the EOT unit identifier in the message is compared to any EOT unit identifiers that are included in a temporary block list at step 512. The temporary block list is a list of EOT unit identifiers from which a message indicating an emergency status has been received and for which an alert to the operator has been generated. The temporary block list is used to avoid generating excessive alerts to the operator. As discussed above, an EOT unit typically sends messages indicating status on the order of once per minute. Thus, an HOT device approaching an EOT unit on a train that has stopped may receive a message indicating zero brake pipe pressure once every minute. Once an operator has been alerted to the presence of such an EOT unit and has acknowledged the alert, it is undesirable to generate a second alert one minute later. Therefore, if the EOT unit identifier received in the message is on the temporary block list at step 512, the message is ignored and step 599 is performed.

Step 599 involves clearing EOT unit identifiers on the temporary block list. While it is desirable to avoid generating an alert for the same EOT unit every minute, alerts for the EOT unit cannot remain blocked forever and there must be a mechanism for removing a temporarily blocked EOT unit identifier from the list. Therefore, when an EOT identifier is added to the temporary block list, an associated time is also added. Step 599 is performed by calculating the difference between the current time and the time associated with the temporarily blocked EOT unit identifier and comparing the difference to a threshold (e.g., 10 minutes). If the difference exceeds the threshold, the EOT unit identifier is removed from the temporary block list. Otherwise, the EOT unit identifier remains on the temporary block list.

If the EOT unit identifier is not on the temporary block list at step 512, the message is next checked for the presence of EOT unit position information at step 514. If an EOT unit position is included in the message at step 514, the processor 420 calculates the distance between the HOT and the EOT unit at step 516 using an HOT position from the GPS receiver 480. If this distance is greater than a threshold at step 518, the message is effectively ignored and step 599 is performed. In some embodiments, the threshold is a predetermined, fixed threshold, which may be based on a worst-case estimated stopping distance for the train plus an additional safety factor. In other embodiments, the threshold is variable and includes a safety factor but also depends upon an estimated braking distance for the train, which in turn depends on the speed of the train, the weight of the train, the grade of the track (which can be determined from a database lookup based on the train's current position as reported by the GPS receiver 480), etc. As with step 510, the test of step 518 is performed in order to avoid excessive alerts to the operator (in this case, alerts relating to an EOT unit that is too far away to be of concern to the operator), and this step may be skipped in some embodiments.

If the distance is less than the threshold at step 518, this indicates that an EOT unit that is in somewhat close proximity to an HOT traveling at least at a minimum speed has generated a message indicating that there is an emergency condition or zero brake pipe pressure. These circumstances indicate that a collision may be about to occur. For example, if an EOT status message indicating zero brake pipe pressure is received at a freight train that is traveling in a sparsely populated area far away from any siding or station, there is a possibility that something has gone wrong with another train up ahead and that a collision with this other train may be imminent. This other train may be on the same track and may have had to make an emergency stop or may have had a brake malfunction that caused a loss of brake pipe pressure and thus stoppage of the train. Or this other train may have been on a parallel track and may have derailed, and a portion of the train may now be on the same track. Or vandals may have closed off the brake pipe and separated one or more trailing cars on which the EOT unit transmitting the message is mounted from the remainder of the train as described in U.S. Pat. No. 7,024,089, entitled "Train Control System and Method of Controlling a Train or Trains," the contents of which are hereby incorporated herein by reference. In order to warn the operator of the possibility of a collision, an alert is displayed to the operator at step 520. The alert may be generated visually on the display 450. It should be understood that an audible alert may be used in place of, or in addition to, the visual alert at step 520. If the EOT unit message includes an EOT unit position, the distance between the HOT and EOT unit may also be displayed to the operator along with the alert.

If the operator acknowledges the alert at step 522, the EOT identifier (e.g., the EOT unit serial number) included in the message is entered into a temporary block list at step 524 and step 599 is performed. If the operator fails to acknowledge the alert at step 522, corrective action is taken at step 526. The corrective action may take a number of different forms. In some embodiments, the processor 420 will command the onboard EOT unit to perform an emergency braking action to stop the train. In other embodiments, an additional alert may be generated. For example, if the alert at step 520 is only a visual alert on the display 450, an additional audible alert may be generated.

The embodiments discussed above involve stand-alone HOT devices. It should be understood, however, that the HOT device may be of the type that is used in an integrated locomotive control/display system. Such a device is sometimes referred to as an Integrated HOT device, or IHOT. IHOTs communicate with EOT units and with the locomotive control/display system computer: the information from the EOT units is received at the IHOT and sent to the computer for display to the operator, and commands (e.g., emergency brake commands) are sent from the computer to the IHOT and then passed from the IHOT to the EOT unit.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed is:

1. A method for enhancing the safety of a train using a processor, the method comprising the steps of:

storing on a device mounted onboard the train a first identifier of an end of train (EOT) unit, the first identifier corresponding to a first EOT unit attached at an end of the train;

receiving on a device mounted on the train a message from a second end of train unit, the message having a second identifier of the second EOT unit, the second identifier being different from the first identifier, the second end of train unit being located off the train; and alerting an operator of the train as to the presence of the second EOT unit if the message indicates that the second EOT unit has sensed a zero brake pipe pressure or indicates an emergency condition.

2. The method of claim 1, further comprising the step of:

determining a speed of the train;

wherein the alerting step is not performed if the speed of the train is below a speed threshold.

3. The method of claim 1, further comprising the steps of:

obtaining a position of the second EOT unit from the message; and calculating a distance between the train and the second EOT unit;

wherein the alerting step is not performed if the distance is above a distance threshold.

4. The method of claim 3, wherein the threshold depends at least in part on a speed of the train.

5. The method of claim 3, further comprising the step of displaying the distance to the operator.

6. The method of claim 1, further comprising the step of taking corrective action if an operator of the train fails to acknowledge the alert.

7. The method of claim 1, further comprising the steps of:

storing the second identifier together with a time after receiving the message;

receiving a second message;

comparing an EOT identifier in the second message to the second identifier; and generating a second operator alert only if the EOT identifier in the second message does not match the second identifier or if a difference between a current time and the time stored in the storing step is greater than a threshold.

8. The method of claim 7, wherein the time stored in the storing step is a time at which the message with the second identifier is received.

9. The method of claim 7, wherein the time stored in the storing step is a time at which the alerting step is performed.

10. The method of claim 1, wherein the alert is a visual alert.

11. A device for enhancing the safety of a train, the device comprising:

a processor located on the train;

a memory connected to the processor; and a transceiver connected to the processor, the transceiver being configured for wireless communication with an end of train unit;

wherein the processor is configured to perform the steps of:

storing in the memory a first identifier of an EOT unit, the first identifier corresponding to a first EOT unit attached at an end of the train;

receiving via the transceiver a message from a second end of train unit, the message having a second identifier of the second EOT unit, the second identifier being different from the first identifier, the second end of train unit being located off the train; and alerting an operator of the train as to the presence of the second EOT unit if the message indicates that the second EOT unit has sensed a zero brake pipe pressure or indicates an emergency condition.

12. The device of claim 11, wherein the processor is further configured to perform the step of:

determining a speed of the train;

wherein the alerting step is not performed if the speed of the train is below a speed threshold.

13. The device of claim 11, wherein the processor is further configured to perform the step of:

obtaining a position of the second EOT unit from the message; and calculating a distance between the train and the second EOT unit;

wherein the alerting step is not performed if the distance is above a distance threshold.

14. The device of claim 13, wherein the threshold depends at least in part on a speed of the train.

15. The device of claim 13, further comprising a display device connected to the processor, wherein the processor is further configured to perform the step of displaying the distance between the train and the second EOT unit to the operator on the display device.

16. The device of claim 11, wherein the processor is further configured to perform the step of taking corrective action if an operator of the train fails to acknowledge the alert.

17. The device of claim 11, wherein the processor is further configured to perform the steps of:

storing the second identifier together with a time after receiving the message in the memory;

receiving a second message;

comparing an EOT identifier in the second message to the second identifier; and generating a second operator alert only if the EOT identifier in the second message does not match the second identifier or if a difference between a current time and the time stored in the storing step is greater than a threshold.

18. The device of claim 17, wherein the time stored in the storing step is a time at which the message with the second identifier is received.

19. The device of claim 17, wherein the time stored in the storing step is a time at which the alerting step is performed.

20. The device of claim 11, further comprising a display connected to the processor, wherein the alert is a visual alert.

21. The device of claim 20, wherein the display is mounted in a same housing in which the processor is mounted.

* * * * *